US006803908B2

(12) United States Patent
Fujise et al.

(10) Patent No.: US 6,803,908 B2
(45) Date of Patent: Oct. 12, 2004

(54) SEMICONDUCTOR INTEGRATED CIRCUIT

(75) Inventors: Takashi Fujise, Nagano-ken (JP); Norimitsu Baba, Nagano-ken (JP)

(73) Assignee: Seiko Epson Corporation (JP)

( * ) Notice: Subject to any disclaimer, the term of this patent is extended or adjusted under 35 U.S.C. 154(b) by 138 days.

(21) Appl. No.: 10/023,454

(22) Filed: Dec. 17, 2001

(65) Prior Publication Data

US 2002/0118290 A1 Aug. 29, 2002

(30) Foreign Application Priority Data

Dec. 19, 2000 (JP) ..... 2000-385529

(51) Int. Cl.[7] ..... G09G 5/00
(52) U.S. Cl. ..... 345/205; 345/98; 345/55
(58) Field of Search ..... 345/87–103, 204–206, 345/501, 519, 530, 208–210, 55

(56) References Cited

U.S. PATENT DOCUMENTS 5,241,304 A * 8/1993 Munetsugu et al. ..... 345/784
5,260,698 A * 11/1993 Munetsugu et al. ..... 345/205
5,321,811 A * 6/1994 Kato et al. ..... 395/166
5,448,259 A * 9/1995 Hidaka ..... 345/99
5,523,773 A * 6/1996 Arakawa et al. ..... 345/98
5,623,277 A * 4/1997 Lippmann et al. ..... 345/87
5,764,212 A * 6/1998 Nishitani et al. ..... 345/98
6,160,533 A * 12/2000 Tamai et al. ..... 345/89
6,344,843 B1 * 2/2002 Koyama et al. ..... 345/100
6,433,768 B1 * 8/2002 Miyazawa et al. ..... 345/98
6,473,059 B1 * 10/2002 Yasue ..... 345/3.1

* cited by examiner

*Primary Examiner*—Lun-Yi Lao
(74) *Attorney, Agent, or Firm*—Harness, Dickey & Pierce, P.L.C.

(57) ABSTRACT

A semiconductor integrated circuit comprises a storage device that receives an input of data representative of an image to be displayed on a display apparatus and stores the data in a manner corresponding to a plurality of signal electrodes of the display apparatus, and outputs the stored data from a plurality of output terminals, a signal generation device that generates a plurality of signals to be supplied to the plurality of signal electrodes of the display apparatus based on data input through a plurality of input terminals, and outputs the same from a plurality of output terminals, and a selection device that selects data input from the plurality of output terminals of the storage device according to a selection signal that is externally input, and supplies the same to the plurality of input terminals of the signal generation device.

4 Claims, 7 Drawing Sheets

PRIOR ART

SEMICONDUCTOR INTEGRATED CIRCUIT

BACKGROUND OF THE INVENTION

1. Technical Field of the Invention

The present invention relates to a semiconductor integrated circuit (liquid crystal driver IC) that drives a display apparatus such a liquid crystal panel, and more particularly to a semiconductor integrated circuit in which a random access memory (RAM) that stores display data.

2. Conventional Art

Liquid crystal panels are widely used in display sections of small equipment such as watches and hand-carry telephones. Further, in recent years, while the amount of data to be displayed is increasing, smaller screens, screens with an improved view ability and more beautiful images are sought. To display an image more beautifully and clearly on a screen of a display apparatus such as liquid crystal panel or the like, the size of each pixel (dot) may be made smaller, and the number of pixels per unit area may be increased. To do this, the space between scanning electrodes of the liquid crystal panel and the space between signal electrodes also need to be narrowed.

FIG. 7 shows a circuit substrate 43 that mounts a conventional liquid crystal driver IC 41 and a conventional liquid crystal panel 42. In FIG. 7, a plurality of terminals for outputting scanning signals C0–C7 from the liquid crystal driver IC 41 are connected to a plurality of scanning electrodes of the liquid crystal panel 42 through wiring patterns formed in a U-shape on the circuit substrate 43. Also, a plurality of terminals for outputting display signals S0–S15 from the liquid crystal driver IC 41 are connected to a plurality of signal electrodes of the liquid crystal panel 42 through wiring patterns formed in a linear-shape on the circuit substrate 43.

In such a liquid crystal panel, if the space between scanning electrodes and the space between signal electrodes of the liquid crystal panel are narrowed to increase the number of pixels per unit area, the pitch of the electrodes on the side of the circuit substrate also needs to be narrowed.

However, because many signal electrodes are provided on the liquid crystal panel, the wiring pitch of the wiring patterns to be connected to the signal electrodes reaches its limit in an attempt to narrow the pitch of the signal electrodes, and therefore it is difficult to achieve a higher degree of pattern density. Also, if the wiring pitch of the wiring patterns is excessively narrowed on the circuit substrate, there occurs a problem in which the mounting accuracy with respect to the substrate is lowered.

In view of the problems described above, it is an object of the present invention to provide a semiconductor integrated circuit (liquid crystal driver IC) that can be connected to a display apparatus such as a conventional liquid crystal panel, and also a display apparatus having an increased number of pixels per unit area, without excessively narrowing the wiring pitch on a circuit substrate.

It is noted that a circuit substrate in the present application means, but is not limited to, a printed substrate, a flexible substrate, a transparent dielectric substrate or the like that can be connected to a liquid crystal panel and can mount a liquid crystal driver IC thereon, and has electrical wirings.

SUMMARY OF THE INVENTION

To solve the problems described above, a semiconductor integrated circuit in accordance with a first aspect of the present invention pertains to a semiconductor integrated circuit that drives a display apparatus, the semiconductor integrated circuit comprising: a storage device that receives an input of data representative of an image to be displayed on the display apparatus and stores the data in a manner corresponding to a plurality of signal electrodes of the display apparatus, and outputs the stored data from a plurality of output terminals; a signal generation device that generates a plurality of signals to be supplied to the plurality of signal electrodes of the display apparatus based on data input through a plurality of input terminals, and outputs the same from a plurality of output terminals; and a selection device that selects data input from the plurality of output terminals of the storage device according to a selection signal that is externally input, and supplies the same to the plurality of input terminals of the signal generation device.

Also, a semiconductor integrated circuit in accordance with a second aspect of the present invention pertains to a semiconductor integrated circuit for driving a display apparatus, the semiconductor integrated circuit comprising: a storage device that receives an input of data representative of an image to be displayed on the display apparatus and an address signal, stores the data in regions designated by the address signal, and outputs the stored data from a plurality of output terminals; a selection device that selects a plurality of addresses that are externally input according to a selection signal that is externally input, and supplies the same to the storage device; and a signal generation device that generates a plurality of signals to be supplied to the plurality of signal electrodes of the display apparatus based on data input through a plurality of input terminals from the plurality of output terminals of the storage device, and outputs the same from a plurality of output terminals.

DETAILED DESCRIPTION OF THE PREFERRED EMBODIMENTS OF THE PRESENT INVENTION

Embodiments of the present invention are described below with reference to the accompanying drawings. It is noted that the same components are referred to by the same reference numbers, and their description is omitted.

Figure 1:
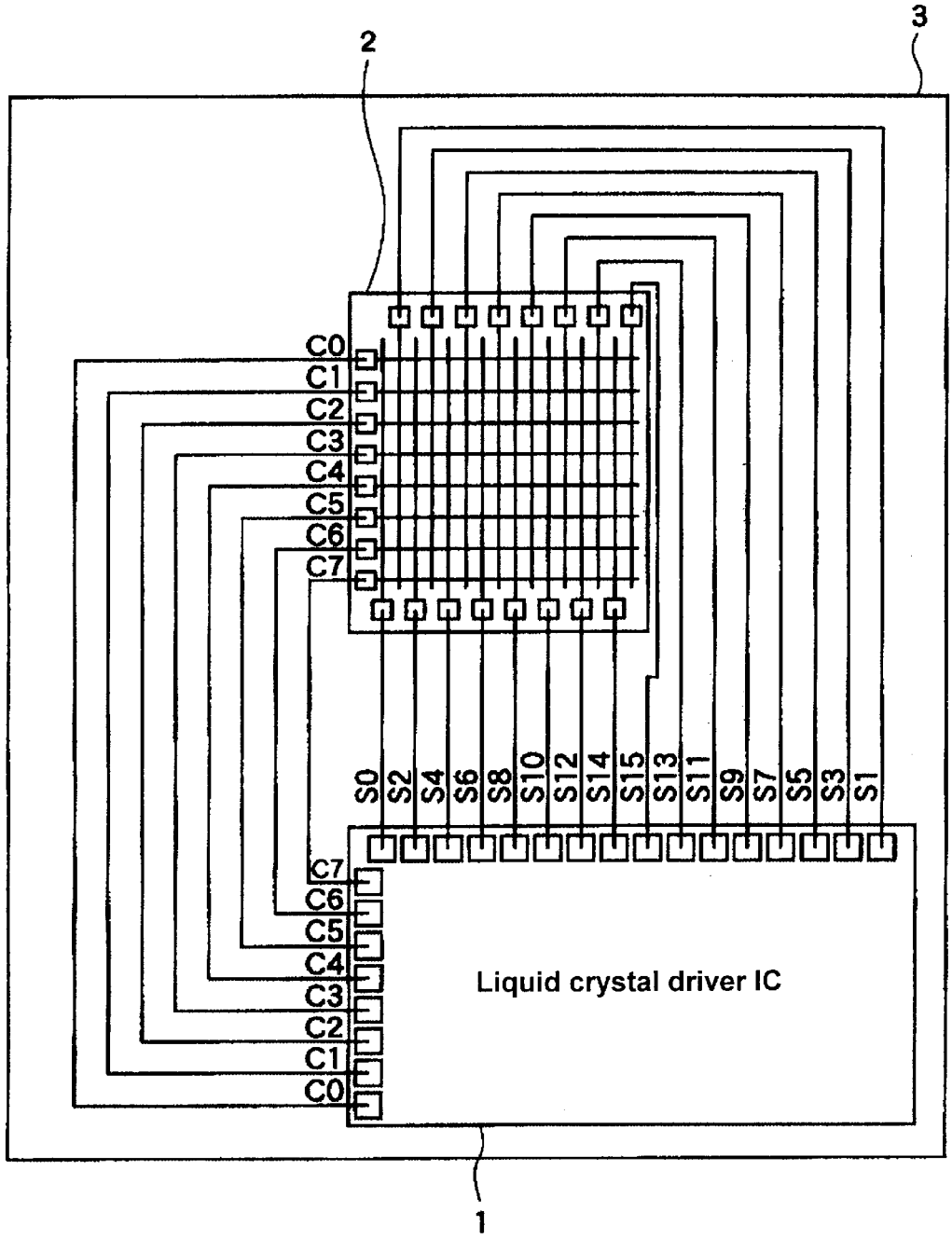
FIG. 1 shows a state in which a semiconductor integrated circuit in accordance with a first embodiment of the present invention and a liquid crystal panel are mounted on a printed substrate.
Figure 2:
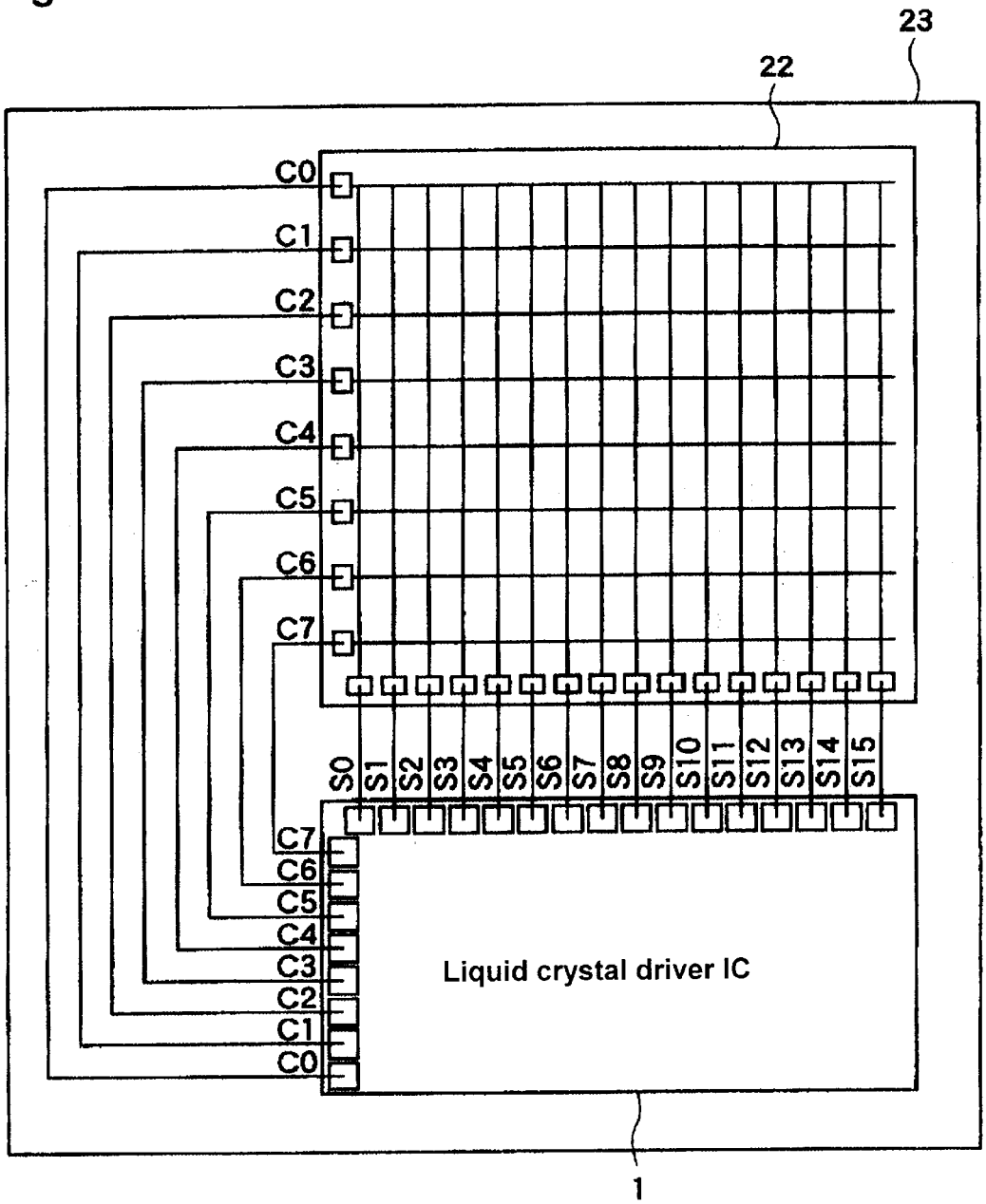
FIG. 2 shows a state in which the semiconductor integrated circuit in accordance with the first embodiment of the present invention and a conventional liquid crystal panel are mounted on a printed substrate.

FIG. 1 and FIG. 2 show states in which a semiconductor integrated circuit in accordance with a first embodiment of the present invention and a liquid crystal panel are mounted on a printed substrate. In this embodiment, the present invention is applied to a liquid crystal driver IC.

Figure 7:
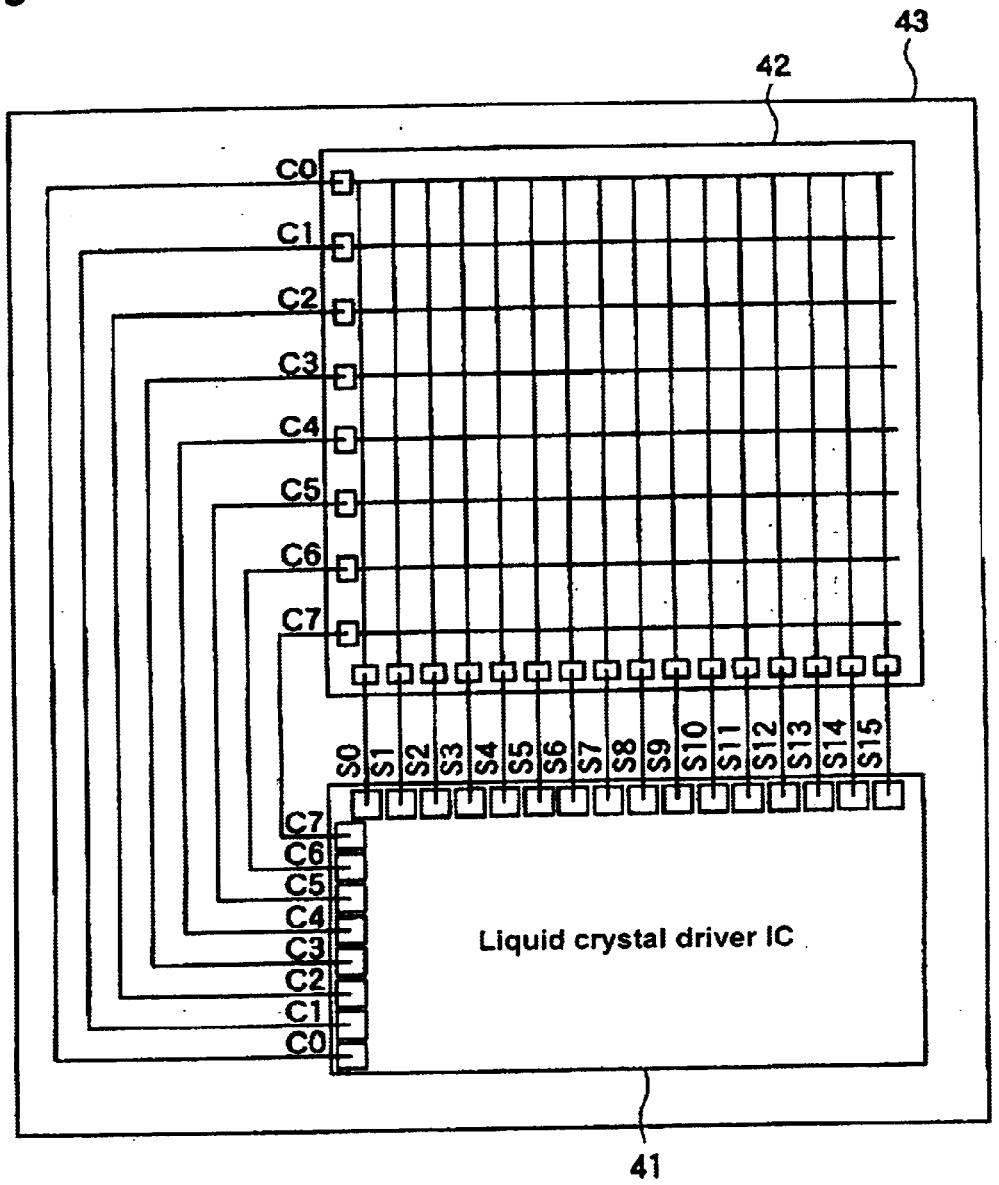
FIG. 7 shows a wiring diagram in which a conventional semiconductor integrated circuit and a conventional liquid crystal panel are mounted on a circuit substrate.

A liquid crystal panel 2 shown in FIG. 1 has a smaller space between signal electrodes in order to increase the number of pixels per unit area compared to a conventional liquid crystal panel 22 shown in FIG. 7. For this reason, signal electrodes in which display signals S0–S15 are supplied are divided into upper and lower portions in the figure, such that the adjacent signal electrodes will not be disposed too densely. By disposing the terminals in this manner, a wiring pattern can be connected to the liquid crystal panel 2 in a staggered wiring fashion, and the wiring pitch does not become too narrow.

It is noted that the "staggered wiring" means a wiring in which the signal lines are alternately provided up and down or left and right, for example, even numbered ones of the signal lines are wired from the lower side and odd numbered ones of the signal lines are wired from the upper side, when the terminals of the liquid crystal panel 2 are connected to the wiring pattern. By the staggered wiring, even when the space between signal electrodes of the liquid crystal panel 2 is reduced in half, the wiring pitch on the print substrate can be maintained in a conventional manner. Accordingly, the pixel density of the liquid crystal can be improved while maintaining the mounting accuracy.

A liquid crystal driver IC 1 that drives the liquid crystal panel 2 has a built-in RAM (random access memory) that stores display data. Display signals S0–S15 to be supplied to the respective signal electrodes of the liquid crystal panel 2 are generated based on the display data.

Referring to FIG. 1, the wiring is provided such that the display signals S0, S2, . . . and S14 are input from the lower side in the figure, and the display signals S1, S3, . . . and S15 are input from the upper side in the figure.

On the other hand, in FIG. 2, the wiring is provided such that all of the display signals S0, S1, S2, . . . and S15 are input from the lower side in the figure, in the same arrangement as that of the outputs of the RAM.

Also, in FIG. 1 and FIG. 2, the wiring is provided such that scanning signals C0–C7 are input from the left side in the figure.

However, when the terminals are disposed in a manner shown in FIG. 1, the arrangement of display signals that are output based on display data stored in the RAM of the liquid crystal driver IC 1 will not be consistent with the arrangement of the signal electrodes of the liquid crystal panel 2. Accordingly, the arrangement of the display signals needs to be changed in the liquid crystal driver IC 1. If a CPU (central processing unit) performs such a control, the load on the CPU increases. Accordingly, in accordance with the present embodiment, the liquid crystal driver IC 1 is provided with a selection circuit (selector) for outputs of the RAM, to thereby change the arrangement of outputs of the display signals.

Figure 3:
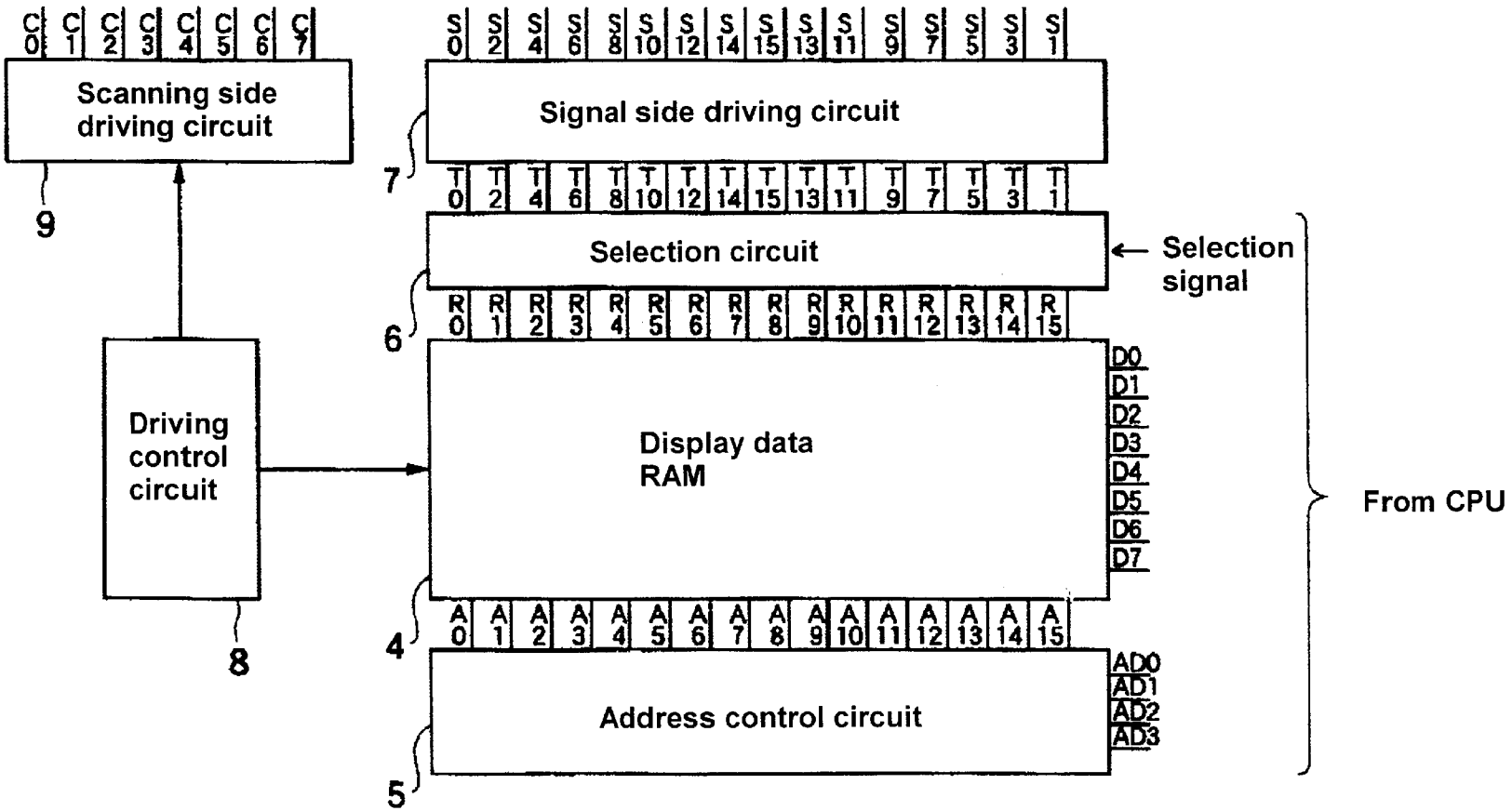
FIG. 3 shows a structure of the semiconductor integrated circuit in accordance with the first embodiment of the present invention.

FIG. 3 shows a structure of a liquid crystal driver IC in accordance with one embodiment of the present invention. As shown in FIG. 3, the liquid crystal driver IC includes a display data RAM 4 that receives an input of display data representative of an image to be displayed on the liquid crystal panel and stores the data in a manner corresponding to a plurality of signal electrodes of a liquid crystal panel, and outputs the stored display data from a plurality of output terminals. An address control circuit 5 designates regions for storing the display data in the display data RAM 4.

Also, a selection circuit 6 selects display data input from the plurality of output terminals of the display data RAM 4 according to a selection signal that is input from a CPU, and supplies the same to a plurality of input terminals of a signal side driving circuit 7. The signal side driving circuit 7 generates a plurality of signals to be supplied to the plurality of signal electrodes of the liquid crystal panel based on the display data input through the plurality of input terminals, and outputs the same from a plurality of output terminals.

In other words, the selection circuit 6 rearranges the positions of the display data R1–R15 that are input from the display data RAM 4 according to a selection signal representative of the staggered wiring or the normal wiring input from the CPU, and outputs the same. When the staggered wiring is selected, as shown in FIG. 3, the display data T0, T2, . . . , T14, T15, T13, . . . , T1 are output.

The signal side driving circuit 7 converts the display data input from the selection circuit 6 into driving signals to generate display signals S0, S2, . . . , S14, S15, S13, . . . S1, and outputs the same to the liquid crystal panel. A driving control circuit 8 controls the read timing for the display data RAM 4, and also controls a scanning side driving circuit 9, and supplies scanning signals to the liquid crystal panel.

Figure 4:
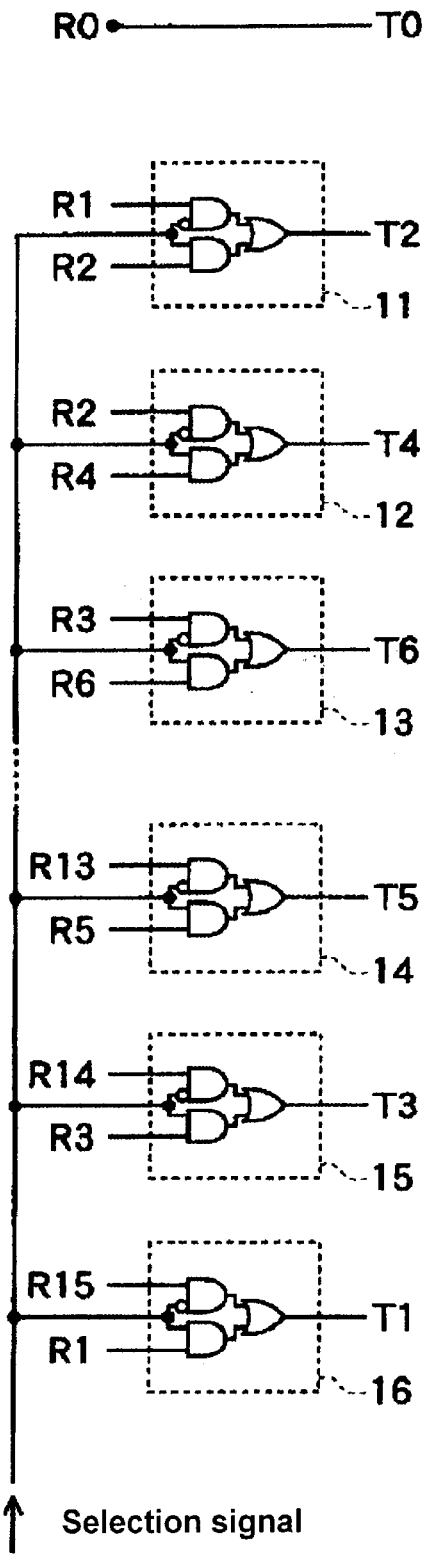
FIG. 4 shows a circuit diagram of a structure of a selection circuit in FIG. 3.

Next, the selection circuit 6 shown in FIG. 3 is described in detail. FIG. 4 shows a circuit diagram of a structure of the selection circuit. When display data R0–R15 from the display data RAM are input to the selection circuit, each of the display data is input to circuits 11–16 shown in FIG. 4. On the other hand, a selection signal from the CPU is input to the circuits 11–16. It is noted that display data R0 is always output as display data T0.

Here, when the staggered wiring is selected, as shown in FIG. 4, the circuits 11, 12, 13, . . . , 14, 15 and 16 respectively select display data R2, R4, R6, . . . , R5, R3 and R1, and output them as T2, T4, T6, . . . , T5, T3 and T1. On the other hand, when a normal wiring is selected, the circuits 11, 12, 13, . . . , 14, 15 and 16 respectively select display data R1, R2, R3, . . . , R13, R14 and R15, and output them as T1, T2, T3, . . . , T13, T14 and T15.

Referring back to FIG. 3, the display data rearranged and selected by the selection circuit 6 are converted into display signals by the signal side driving circuit 7 and output to the liquid crystal panel. In this instance, when the display signals are arranged for a staggered wiring, the staggered wiring shown in FIG. 1 may be provided when the liquid crystal panel is mounted, such that the display signals will be input to the liquid crystal panel in its original order. On the other hand, when the display signals are arranged for a normal wiring, the normal wiring shown in FIG. 2 may be provided, such that the display signals will be input to the liquid crystal panel in its original order.

In this manner, in accordance with the present embodiment, the selection circuit is provided on the output side of the display data RAM in the liquid crystal driver IC. As a result, based on a selection signal provided from the CPU, the arrangement of display signals for the staggered wiring and the arrangement of display signals for the normal wiring can be switched from one to the other.

Figure 5:
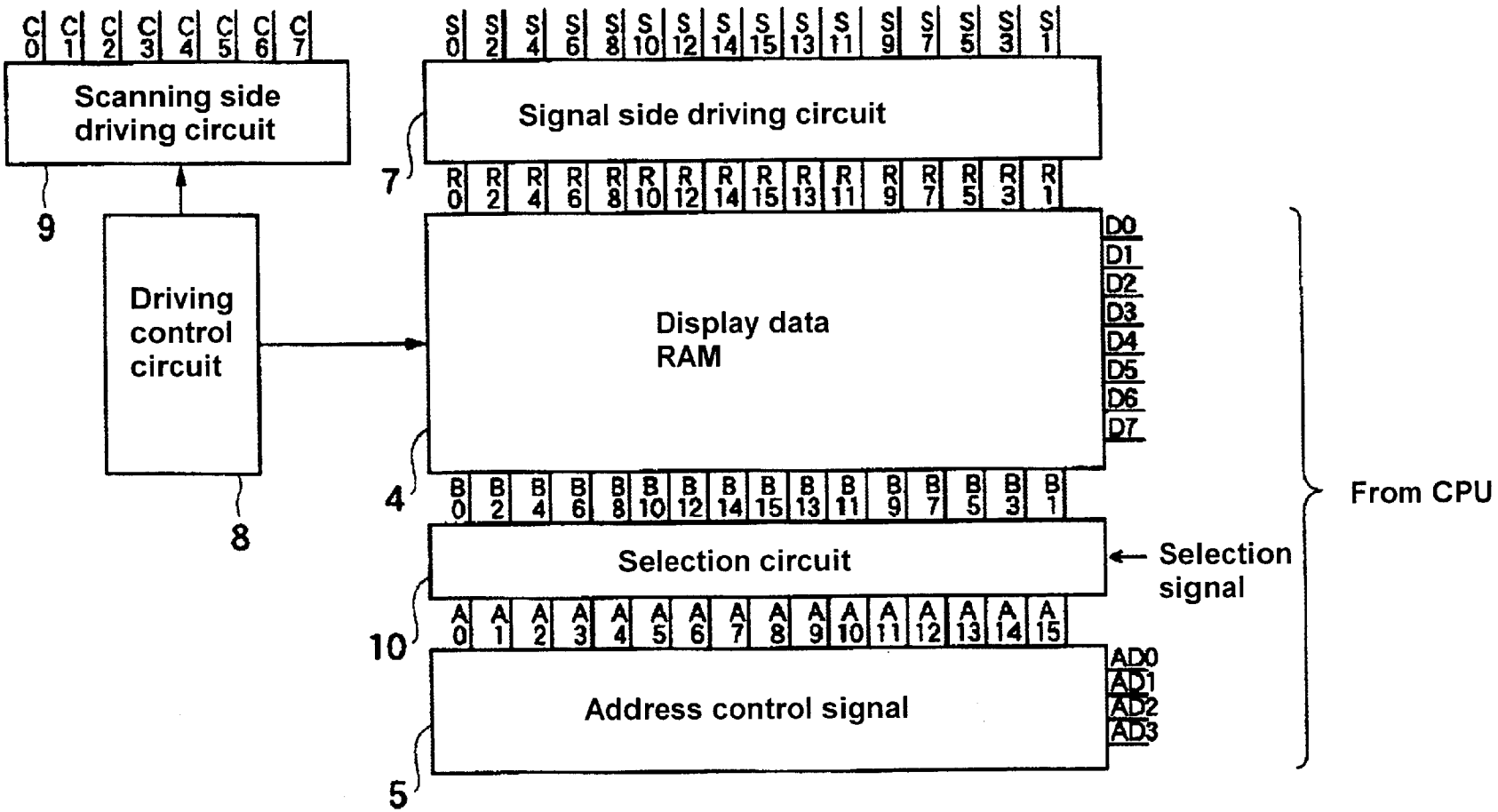
FIG. 5 shows a structure of a semiconductor integrated circuit in accordance with a second embodiment of the present invention.

Next, a semiconductor integrated circuit in accordance with a second embodiment of the present invention is described. FIG. 5 shows a structure of a semiconductor integrated circuit (liquid crystal driver IC) in accordance with the present embodiment. In FIG. 5, a selection circuit 10 for selecting the arrangement of display signals to be output from a liquid crystal driver IC is provided at the side of an address control circuit of a display data RAM. In other words, in accordance with the present embodiment, addresses are allocated according to the arrangement for the normal wiring or the arrangement for the staggered wiring based on a selection signal at a stage when display data is written to a display data RAM 4 or read out from the display data RAM 4.

Figure 6:
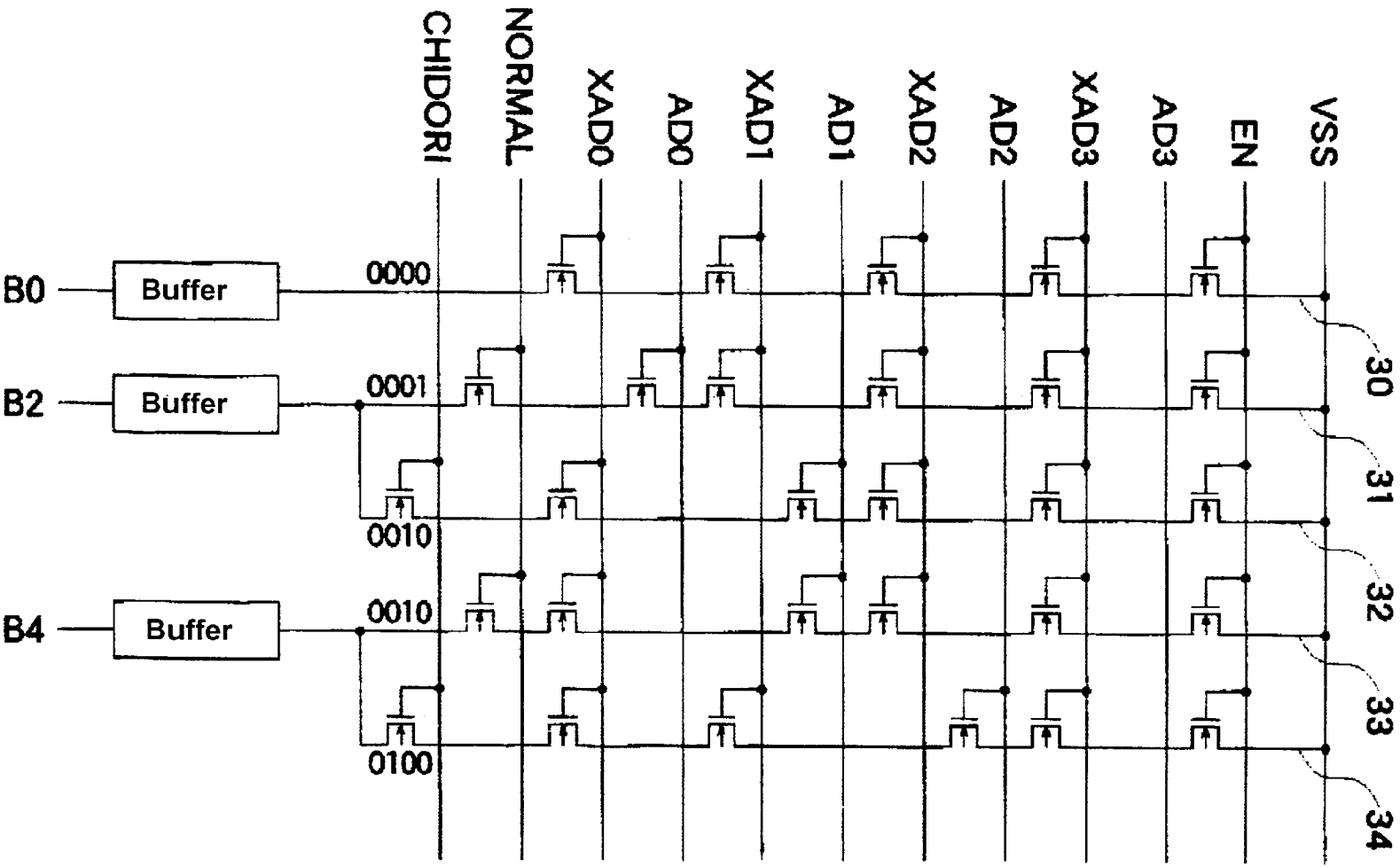
FIG. 6 shows a circuit diagram of a structure of an address control circuit and a selection circuit in FIG. 5.

FIG. 6 shows a circuit diagram of a structure of the address control circuit 5 and the selection circuit 10 shown in FIG. 5. In FIG. 6, whether addresses for a normal wiring or addresses for the staggered wiring are selected is determined by a signal input from the CPU to a NORMAL line or a CHIDORI line.

For example, when the normal wiring is conducted, the application of a voltage to the NORMAL line causes a line 31 among lines 31 and 32 that are connected to a line B2 to be selected and an address 0001 (1 in the decimal system) to be allocated. Similarly, a line 33 among lines 33 and 34 that are connected to a line B4 will be selected and an address 0010 (2 in the decimal system) will be allocated.

When the staggered wiring is conducted, the application of a voltage to the CHIDORI line causes the line 32 among the two lines that are connected to the line B2 to be selected and an address 0010 (2 in the decimal system) to be allocated. Similarly, the line 34 on the line B4 will be selected and an address 0100 (4 in the decimal system) will be allocated.

In the manner described above, selected addresses are supplied to the display data RAM, whereby the arrangement of display signals that are output from a liquid crystal driver IC is switched between the normal wiring and the staggered wiring.

As described above, in accordance with the present invention, a selection circuit is added to a liquid crystal driver IC, such that the arrangement of display signals output can be switched based on a selection signal. Therefore, the normal wiring and the staggered wiring can be switched from one to the other while using the same liquid crystal driver IC without giving a load to a CPU. Also, by using the staggered wiring, a highly densified liquid crystal panel can be mounted without narrowing the wiring pitch on the circuit substrate.

A printed substrate is described above as an example of a circuit substrate. However, the same effects can be obtained even when a substrate of another type such as a flexible substrate or a transparent dielectric substrate is used.

The entire disclosure of Japanese Patent Application No. 2000-385529 filed Dec. 19, 2000 and Japanese Patent Application No. 2000-291007 filed Sep. 25, 2000 is incorporated by reference herein.

What is claimed is:

1. A semiconductor integrated circuit for driving a display apparatus, the semiconductor integrated circuit comprising:

a storage device adapted to receive an input of data representative of an image to be displayed on the display apparatus, store the data in a manner corresponding to a first arrangement of a plurality of signal electrodes of the display apparatus, and output the stored data from a plurality of output terminals;

a signal generation device adapted to generate a plurality of signals to be supplied to the plurality of signal electrodes of the display apparatus based on data input through a plurality of input terminals, and output the same from a plurality of output terminals; and a selection device interposed between the storage device and the signal generation device, the selection device adapted to rearrange the data input from the plurality of output terminals of the storage device according to a selection signal that is externally input, and supply the same to the plurality of input terminals of the signal generation device.

2. The semiconductor integrated circuit of claim 1 wherein the selection signal being indicative of a second arrangement of the plurality of signal electrodes that is different than the first arrangement.

3. A semiconductor integrated circuit for driving a display apparatus, the semiconductor integrated circuit comprising:

a storage device adapted to receive an input of data representative of an image to be displayed on the displayed apparatus and an address signal, store the data in regions designated by the address signal, and output the stored data from a plurality of output terminals;

a selection device adapted to select a plurality of addresses that are externally input according to a selection signal that is externally input, and supply the same to the storage device, wherein the selection signal is indicative of an arrangement of a plurality of signal electrode of the display apparatus; and a signal generation device adapted to generate a plurality of signals to be supplied to the plurality of signal electrodes of the display apparatus based on data input through a plurality of input terminals from the plurality of output terminals of the storage device, and output the same from a plurality of output terminals.

4. A method of driving a display apparatus comprising:

receiving an input of data representative of an image to be displayed on the display apparatus;

storing the data in a manner corresponding to an arrangement of a plurality of signal electrodes of the display apparatus;

outputting the stored data from a plurality of output terminals;

generating a plurality of signals to be supplied to the plurality of signal electrodes of the display apparatus based on data input through a plurality of input terminals;

outputting the plurality of signals from the plurality of output terminals;

selecting data input from the plurality of output terminals according to a selection signal that is externally input, wherein the selection signal is indicative of an alternative arrangement of a plurality of signal electrode of the display apparatus; and supplying the selected data to the plurality of input terminals.

* * * * *